US006241510B1

(12) United States Patent
Anderson et al.

(10) Patent No.: US 6,241,510 B1
(45) Date of Patent: Jun. 5, 2001

(54) SYSTEM FOR PROVIDING PROXIMATE TURBULENT AND COHERENT GAS JETS

(75) Inventors: John Erling Anderson, Somers; Balu Sarma, Airmont; Ronald Joseph Selines, North Salem; Pravin Chandra Mathur, Bronx, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/495,862

(22) Filed: Feb. 2, 2000

(51) Int. Cl.[7] ..... F23C 5/00

(52) U.S. Cl. ..... 431/8; 431/181; 431/187; 431/158; 239/424.5

(58) Field of Search ..... 431/8, 9, 10, 158, 431/159, 164, 165, 166, 181, 187, 351, 350, 190, 4; 239/400, 42.8, 424.5, 433, 422; 266/225; 75/414, 708, 530

(56) References Cited

U.S. PATENT DOCUMENTS

| | | | | |
|---|---|---|---|---|
| 3,427,151 | | 2/1969 | Koudelka et al. | 75/59 |
| 4,311,277 | * | 1/1982 | Stratton | 239/400 |
| 4,622,007 | | 11/1986 | Gitman | 432/13 |
| 4,969,814 | * | 11/1990 | Ho et al. | 431/8 |
| 5,100,313 | | 3/1992 | Anderson et al. | 431/8 |
| 5,601,425 | * | 2/1997 | Kobayashi et al. | 431/8 |
| 5,714,113 | | 2/1998 | Gitman et al. | 266/182 |
| 5,743,723 | * | 4/1998 | Iatrides et al. | 431/8 |
| 5,762,486 | * | 6/1998 | Leger | 431/8 |
| 5,814,125 | | 9/1998 | Anderson et al. | 75/414 |
| 5,823,762 | | 10/1998 | Anderson et al. | 431/8 |
| 5,944,507 | * | 8/1999 | Feldermann | 431/181 |
| 5,975,886 | * | 11/1999 | Philippe | 431/165 |
| 6,071,115 | * | 6/2000 | Carbone et al. | 431/8 |
| 6,139,310 | * | 10/2000 | Mahoney et al. | 431/8 |
| 6,176,894 | * | 1/2001 | Anderson et al. | 75/414 |

FOREIGN PATENT DOCUMENTS

| | | | |
|---|---|---|---|
| 866139 | | 9/1998 | (EP) . |
| 58-145809 | * | 8/1983 | (JP) . |

* cited by examiner

*Primary Examiner*—Marvin M. Lateef
*Assistant Examiner*—Josiah C. Cocks
(74) *Attorney, Agent, or Firm*—Stanley Ktorides

(57) ABSTRACT

A system for providing gases into an injection volume in one or more coherent gas jets proximate to one or more turbulent gas jets wherein a coherent gas jet is formed in a forming volume with a flame envelope prior to passage into the injection volume into which the turbulent gas jets are directly passed.

10 Claims, 2 Drawing Sheets

SYSTEM FOR PROVIDING PROXIMATE TURBULENT AND COHERENT GAS JETS

TECHNICAL FIELD

This invention relates generally to gas dynamics and, more particularly, to coherent gas jet technology.

BACKGROUND ART

A recent significant advancement in the field of gas dynamics is the development of coherent jet technology which produces a laser-like jet of gas which can travel a long distance while still retaining substantially all of its initial velocity and with very little increase to its jet diameter. One very important commercial use of coherent jet technology is for the introduction of gas into liquid, such as molten metal, whereby the gas lance may be spaced a large distance from the surface of the liquid, enabling safer operation as well as more efficient operation because much more of the gas penetrates into the liquid than is possible with conventional practice where much of the gas deflects off the surface of the liquid and does not enter the liquid.

It is sometimes desirable to have both a coherent gas jet and a turbulent gas jet in an industrial operation. For example, in steelmaking it is sometimes desirable to use a coherent gas jet to inject gas into molten metal for stirring purposes while using one or more turbulent gas jets for combustion and/or decarburization purposes. A turbulent gas jet may be disruptive to another gas jet if they travel close to one another. With existing technology, industrial operations which desire using simultaneously both coherent and turbulent gas jets, require the use of two separate gas delivery systems which is expensive.

Accordingly, it is an object of this invention to provide a system which can effectively provide both a coherent gas jet and a turbulent gas jet proximate to one another into an injection volume.

SUMMARY OF THE INVENTION

The above and other objects, which will become apparent to those skilled in the art upon a reading of this disclosure, are attained by the present invention, one aspect of which is:

A method for providing proximate turbulent and coherent gas jets into an injection volume comprising:

(A) passing a gas jet into a forming volume, passing a flow of fuel into the forming volume annularly to the gas jet, and passing a flow of oxidant into the forming volume annularly to the gas jet;

(B) combusting the oxidant with the fuel to form a flame envelope around the gas jet;

(C) passing the gas jet and the flame envelope out from the forming volume into the injection space, said gas jet being a coherent gas jet; and (D) passing at least one turbulent gas jet into the injection space proximate to the coherent gas jet wherein the flame envelope is between the coherent gas jet and the turbulent gas jet.

Another aspect of the invention is:

Apparatus for providing proximate turbulent and coherent gas jets into an injection volume comprising:

(A) a coherent gas jet provision means comprising a coherent gas nozzle having an output communicating with a forming volume, said forming volume communicating with the injection volume;

(B) means for providing fuel to the forming volume annular to the coherent gas nozzle;

(C) means for providing oxidant to the forming volume annular to the coherent gas nozzle; and (D) a turbulent gas jet provision means proximate the coherent gas jet provision means, said turbulent gas jet provision means comprising a turbulent gas nozzle having an output communicating directly with the injection volume.

As used herein, the term "coherent jet" means a gas jet which is formed by ejecting gas from a nozzle and which has a velocity and momentum profile along its length which is similar to its velocity and momentum profile upon ejection from the nozzle.

As used herein, the term "annular" means in the form of a ring.

As used herein, the term "flame envelope" means an annular combusting stream substantially coaxial with at least one gas stream.

As used herein, the term "length" when referring to a coherent gas jet means the distance from the nozzle from which the gas is ejected to the intended impact point of the coherent gas jet or to where the gas jet ceases to be coherent.

As used herein, the term "turbulent jet" means a gas jet which is formed by ejecting gas from a nozzle and which has a velocity and momentum profile along its length which changes from its velocity and momentum profile upon ejection from the nozzle.

Figure 1:
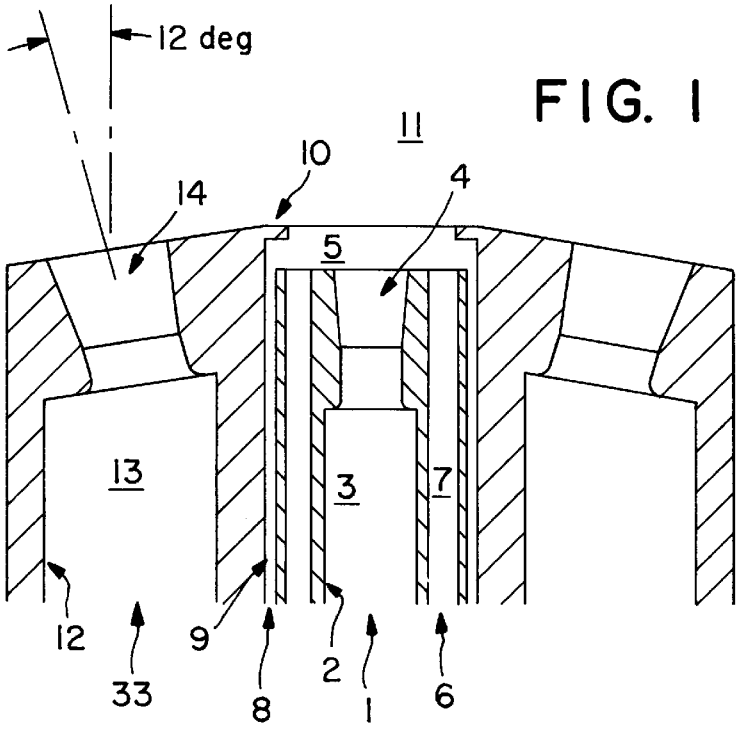
FIG. 1 is a cross sectional representation of one particularly preferred embodiment of a lance tip of the present invention.

The numerals in the Drawings are the same for the common elements.

DETAILED DESCRIPTION

The invention is a system which enables one to simultaneously provide a coherent gas jet and a turbulent gas jet proximate to one another without compromising either type of gas jet or the advantages attainable thereby. Most preferably both of the two different gas jet types are provided using the same lance.

The invention will be described in greater detail with reference to the Drawings. Gas 1 from a gas source (not shown) is passed through coherent gas jet provision means 2 which comprises coherent gas passageway 3 and coherent gas nozzle 4 which, as illustrated in FIG. 1, is preferably a converging/diverging nozzle. Gas 1 may be any useful gas for forming a coherent gas jet. Among such gases one can name oxygen, nitrogen, argon, carbon dioxide, hydrogen, helium, steam, a hydrocarbon gas, and mixtures comprising one or more thereof. Coherent gas nozzle 4 communicates with forming volume 5 and gas 1 passes as a gas jet 30 into forming volume 5.

Fuel 6, from a fuel source (not shown) passes through passageway 7 which is annular to and coaxial with coherent gas passageway 3 and coherent gas nozzle 4. The fuel may be any effective gaseous fuel such as methane, propane or natural gas. Fuel passageway 7 communicates with forming volume 5 and the flow of fuel passes from fuel passageway 7 into forming volume 5 annularly to gas jet 30.

Oxidant 8, from an oxidant source (not shown), passes through passageway 9 which is annular to coherent gas passageway 3 and coaxial with fuel passageway 7. Oxidant 8 may be air, oxygen-enriched air having an oxygen concentration exceeding that of air, or commercial oxygen having an oxygen concentration of at least 99 mole percent. Preferably oxidant 8 is a fluid having an oxygen concentration of at least 25 mole percent. Oxygen passageway 9 communicates with forming volume 5 and the flow of oxidant 8 passes from oxygen passageway 9 into forming volume 5 preferably annularly to the flow of fuel.

The flow of fuel and the flow of oxidant combust to form a flame envelope 31 annular to and coaxial with gas jet 30. Preferably flame envelope 31 has a velocity less than that of gas jet 30 and generally has a velocity within the range of from 300 to 1500 fps. The embodiment of the invention illustrated in FIG. 1 is a preferred embodiment having a deflector 10 which serves to direct the flow of oxidant toward the flow of fuel thus resulting in a more effective flame envelope. Forming volume 5 communicates with injection volume 11 and gas jet 30 and flame envelope 31 flow out from forming volume 5 into injection volume 11. Injection volume 11, for example, could be the headspace of a basic oxygen furnace or other furnace such as a bath smelting furnace, a stainless steelmaking converter, a copper converter, or a high carbon ferromanganese refining furnace.

Gas jet 30, owing to flame envelope 31 preferably with the inwardly directed oxidant flow, is a coherent gas jet and remains a coherent gas jet for its length. Preferably coherent gas jet 30 has a supersonic velocity and generally has a velocity within the range of from 1000 to 2000 feet per second (fps).

Figure 2:
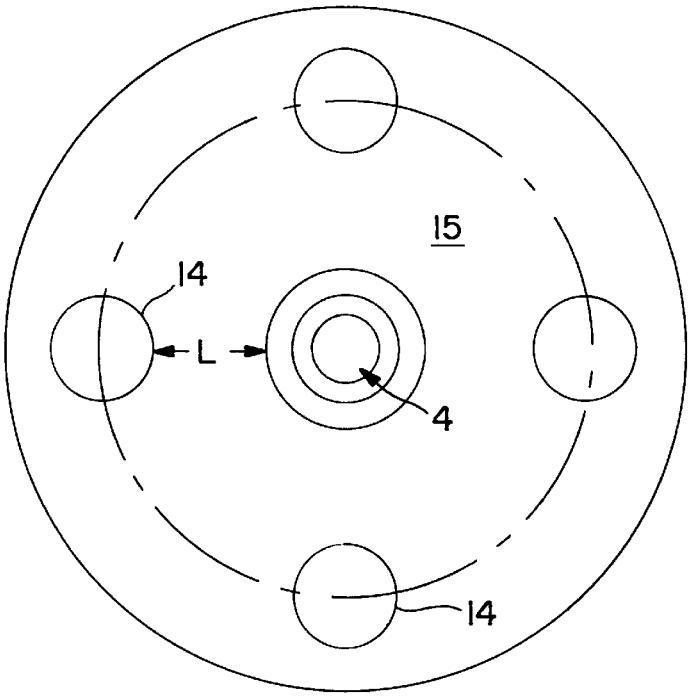
FIG. 2 is a head on view of the apparatus illustrated in FIG. 1.
Figure 3:
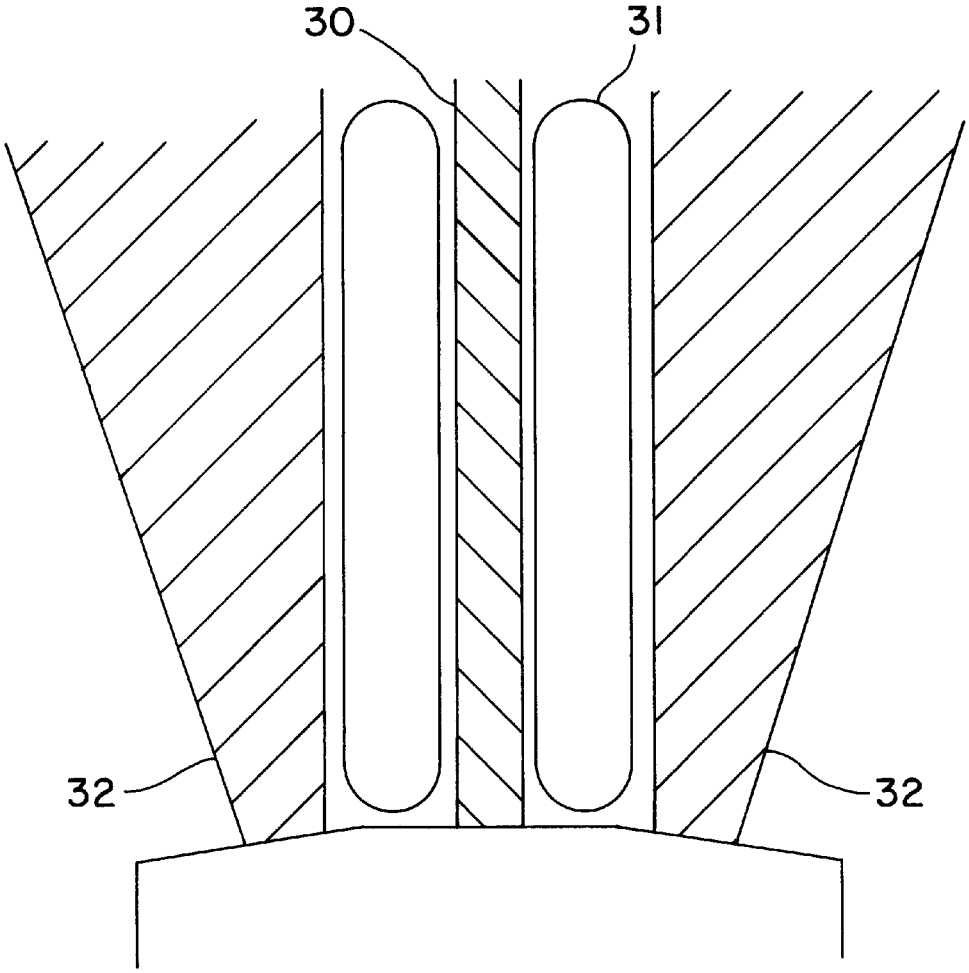
FIG. 3 is a cross sectional representation illustrating the method of the invention in operation.

Proximate to coherent gas jet provision means 2 is at least one turbulent gas jet provisions means 12 comprising a turbulent gas passage 13 and a turbulent gas nozzle 14 communicating directly with injection volume 11. In the embodiment illustrated in the Drawings four such turbulent gas provision means are shown in a circular arrangement around the centrally located coherent gas jet provision means. By proximate it is meant that the closest distance along lance face 15 between turbulent gas nozzle 14 and forming volume 5, shown as "L" in FIG. 2 is not more than 2 inches, and generally within the range of from 0.25 to 2 inches. Preferably, as illustrated in the Drawings, the turbulent gas nozzle(s) are converging/diverging nozzles.

Gas 33 from a gas source (not shown) is passed through turbulent gas provision 13 and turbulent gas nozzle(s) 14. Gas 33 may be any useful gas for forming a turbulent gas jet. Among such gases one can name oxygen, nitrogen, argon, carbon dioxide, hydrogen, helium, steam, a hydrocarbon gas, and mixtures comprising one or more thereof.

Gas flows out of turbulent gas nozzle(s) 14 directly into injection space 11 as one or more turbulent gas jets 32. One particularly preferred gas for forming the turbulent gas jets for use in this invention is an oxygen containing gas, such as air, oxygen-enriched air or commercial oxygen, which may be used to carry out a combustion reaction. The turbulence of such jets aids in achieving more efficient combustion of such combustion reaction.

Despite the nearness of coherent jet 30 and turbulent jet(s) 32, there is no disruption of the coherency of the coherent jet. This stability is due to the initial formation of the coherent jet in the forming volume and the presence of flame envelope 31 in the space between the coherent jet and the turbulent jets.

Tests of the invention were carried out using an embodiment of the invention similar to that illustrated in the Drawings.

Four turbulent supersonic oxygen jets were obtained from the four turbulent gas nozzles angled out 12 degrees simulating a scaled down basic oxygen furnace lance. The nozzles were evenly spaced around a circle, 1.73" diameter (centerlines at the nozzle exits). Each nozzle was converging/diverging with a throat diameter of 0.327" and an exit diameter of 0.426". For the tests, the oxygen flow rate through each nozzle was 10,000 CFH at NTP with a supply pressure upstream of the nozzle of 100 psig. The jet velocity at the exit was about 1600 fps (Mach 2).

Nitrogen was used as the gas for the coherent jet. The nozzle, set at the lance axis, was converging/diverging with a throat diameter of 0.20" and an exit diameter of 0.26". The nitrogen flow rate through the nozzle was 4,000 CFH at NTP with a supply pressure upstream of the nozzle of 100 psig. The jet velocity at the nozzle exit was about 1700 fps (Mach 2).

The flame envelope was provided with an inner annulus (0.555" OD, 0.375" ID) of natural gas and an outer annulus (0.710" OD, 0.625" ID) of annular oxygen. The deflector diverted the secondary oxygen in towards the main nitrogen jet providing a more effective flame envelope. The natural gas and secondary oxygen flow rates were each 500 CFH.

Pitot tube readings were taken at the jet axis 8 inches from the nozzle. With only nitrogen flowing (no natural gas, annular oxygen or oxygen to the turbulent gas nozzles), the pitot tube reading was 2 psig. When the natural gas and annular oxygen were turned on, providing a flame envelope, a coherent nitrogen jet was obtained with a pitot tube reading of 32 psig corresponding to a gas velocity of 1390 fps (Mach 1.4). When the four outer turbulent jets of oxygen (10,000 CFH/jet) were turned on, the pitot tube reading for the nitrogen jet remained essentially the same. The coherent nitrogen jet was not affected by the high entrainment rate into the four outer turbulent oxygen jets.

These results indicate that the key to obtaining a coherent jet proximate one or more turbulent jets is to have the defined flame envelope of the invention between the coherent jet and the turbulent jet. For the experimental example presented herein, a single coherent nitrogen jet was maintained with a ring of four turbulent oxygen jets. Similar results would be expected for two or more coherent jets surrounded by a flame envelope and with coherent jets using other gases such as oxygen, argon, carbon dioxide or natural gas.

Although the invention has been described in detail with reference to a certain particularly preferred embodiment, those skilled in the art will recognize that there are other embodiments of the invention within the spirit and the scope of the claims. For example, for purposes of forming the flame envelope, the oxidant could be provided using the inner annular means and the fuel could be provided using the outer annular means, or more than one provision means for each of the fuel or the oxidant could be employed.

What is claimed is:

1. A method for providing proximate turbulent and coherent gas jets into an injection volume comprising:

(A) passing a gas jet into a forming volume, passing a flow of fuel into the forming volume annularly to the gas jet, and passing a flow of oxidant into the forming volume annularly to the gas jet;

(B) combusting the oxidant with the fuel to form a flame envelope around the gas jet;

(C) passing the gas jet and the flame envelope out from the forming volume into the injection volume, said gas jet being a coherent gas jet having substantially no increase to its jet diameter along its length; and (D) passing at least one turbulent gas jet into the injection volume proximate to the coherent gas jet wherein the flame envelope is between the coherent gas jet and the turbulent gas jet.

2. The method of claim 1 wherein the flow of fuel is annular to the flow of oxidant.

3. The method of claim 1 wherein the flow of oxidant is annular to the flow of fuel.

4. The method of claim 1 wherein the coherent gas jet comprises one or more of nitrogen, oxygen, argon, carbon dioxide or natural gas.

5. The method of claim 1 wherein the turbulent gas jet(s) comprise oxygen.

6. Apparatus for providing proximate turbulent and coherent gas jets into an injection volume comprising:

(A) a coherent gas jet provision means comprising a coherent gas nozzle having an output communicating with a forming volume, said forming volume communicating with the injection volume whereby a gas jet flows from the nozzle into the forming volume and from the forming volume into the injection volume;

(B) means for providing fuel to the forming volume annular to the coherent gas nozzle;

(C) means for providing oxidant to the forming volume annular to the coherent gas nozzle such that the fuel and oxidant combust to form a flame envelope annular to the gas let which has substantially no increase to its jet diameter along its length; and (D) a turbulent gas jet provision means proximate the coherent gas jet provision means, said turbulent gas jet provision means comprising a turbulent gas nozzle having an output communicating directly with the injection volume.

7. The apparatus of claim 6 wherein the coherent gas nozzle is a converging/diverging nozzle.

8. The apparatus of claim 6 wherein the distance from the perimeter of the coherent gas nozzle to the perimeter of the turbulent gas nozzle is within the range of from 0.25 inch to 2 inches.

9. The apparatus of claim 6 comprising a plurality of turbulent gas nozzles.

10. The apparatus of claim 6 further comprising means for directing the oxidant toward the fuel within the forming volume.

* * * * *

UNITED STATES PATENT AND TRADEMARK OFFICE

CERTIFICATE OF CORRECTION

PATENT NO. : 6,241,510 B1
DATED : June 5, 2001
INVENTOR(S) : Anderson et al.

It is certified that error appears in the above-identified patent and that said Letters Patent is hereby corrected as shown below:

Claim 6,
Line 14, delete "let" and insert therefor -- jet --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*